US011848512B2

(12) United States Patent
Graziano et al.

(10) Patent No.: US 11,848,512 B2
(45) Date of Patent: Dec. 19, 2023

(54) INSULATION DISPLACEMENT CONNECTOR FOR SHEATHED INSULATED CABLES

(71) Applicants: TE Connectivity Italia Distribution S.r.l., Collegno (IT); TE Connectivity Italia S.r.l., Collegno (IT)

(72) Inventors: Daniela Graziano, Turin (IT); Alessandro LaMacchia, Alpignano (IT); Riccardo Francesco Robone, Turin (IT)

(73) Assignees: TE Connectivity Italia Distribution S.r.l., Turin (IT); TE Connectivity Italia S.r.l., Turin (IT)

( * ) Notice: Subject to any disclaimer, the term of this patent is extended or adjusted under 35 U.S.C. 154(b) by 275 days.

(21) Appl. No.: 16/824,540

(22) Filed: Mar. 19, 2020

(65) Prior Publication Data

US 2020/0303861 A1 Sep. 24, 2020

(30) Foreign Application Priority Data

Mar. 19, 2019 (IT) ..... 102019000003963

(51) Int. Cl.
*H01R 4/24* (2018.01)
*H01R 13/50* (2006.01)

(52) U.S. Cl.
CPC ..... *H01R 13/501* (2013.01); *H01R 4/24* (2013.01)

(58) Field of Classification Search
CPC .. H01R 4/2433; H01R 4/2466; H01R 9/0787; H01R 13/595; H01R 23/662
See application file for complete search history.

(56) References Cited

U.S. PATENT DOCUMENTS 6,022,240 A * 2/2000 McCleerey ..... H01R 4/2408 439/410
7,021,958 B2 * 4/2006 Shindo ..... H01R 12/598 439/409
7,458,840 B2 12/2008 Pratt
2009/0163058 A1 * 6/2009 Craig ..... H01R 13/447 439/147
2010/0136846 A1 * 6/2010 Pharney ..... H01R 24/64 439/676

FOREIGN PATENT DOCUMENTS

DE 102017208650 A1 11/2018

OTHER PUBLICATIONS

Thermoplastic—Physical properties 2023.*
Extended European search report, EP App. No. 20163657.8-1201, dated Jul. 17, 2020, 7 pages.
Italian Search Report and Written Opinion, Italian App. No. 201900003963, dated Dec. 2, 2019, 7 pages.
Abstract of DE 102017208650, dated Nov. 22, 2018, 2 pages.
European Patent Office Communication, Application No. 20163657.8-1201, dated Mar. 23, 2022, 4 pages.

* cited by examiner

*Primary Examiner* — Phuong Chi Thi Nguyen
(74) *Attorney, Agent, or Firm* — Barley Snyder

(57) ABSTRACT

An insulation displacement connector connecting to a sheathed insulated cable has a housing including a first portion and a second portion mechanically engaging the first portion. The first portion is made of a different material than the second portion.

20 Claims, 4 Drawing Sheets

INSULATION DISPLACEMENT CONNECTOR FOR SHEATHED INSULATED CABLES

CROSS-REFERENCE TO RELATED APPLICATION

This application claims the benefit of the filing date under 35 U.S.C. § 119(a)-(d) of Italian Patent Application No. 102019000003963, filed on Mar. 19, 2019.

FIELD OF THE INVENTION

The present invention relates to a connector and, more particularly, to an insulation displacement connector for sheathed insulated cables.

BACKGROUND

Insulation displacement connections have been extensively developed in the household appliances sector as well as in electronic appliances and more generally in the area of electrical signal transmission. Connections of this type are mostly used for electrical connections not exceeding 25 A and effectively allow a reduction in production costs and easier connection during the production process. In this application there is no need for preliminary operations on the wires or cables that have to be processed, such as stripping the insulation from the cable, thus making it possible to effectively increase production speed and reduce production costs. Thanks to this technology, different types of connection systems have been developed that allow wires or cables to be electrically connected to a connector, which normally includes an electrical terminal and a housing that houses this electrical terminal.

These connectors are commonly known as RAST connectors (from the German "Raster Anschluss Steck Technik"). This connector is based on a standard (RAST standard) that indicates a type of connection based on multiple connectors characterized by a certain "pitch". Usually the abbreviation is followed by a number representing the particular spacing between the different interconnecting lines. For example, a RAST 5 interconnection comprises a connector with 5 mm pitch contacts. The RAST standard touches on a number of connector features, including external dimensions, color coding on the housing, polarization mechanisms to prevent mis-assembly, and locking mechanisms to increase interconnection stability.

These connectors must be able to pass specific tests that simulate the extreme conditions these connectors may encounter. Over time, these tests have become more and more selective in order to obtain connectors that are increasingly safe and able to meet the latest standards.

For example, as described in the UL 749 standard, new household dishwashers are required to have components of a defined flammability class or must pass the "Nichrome Wire Test" by 2020. During this test, the connector is used as a trigger point, energizing a nickel-chromium coil inserted in place of one of its contacts, energized at 11 A for 20 minutes. Most connectors on the market today create flame in the surrounding areas when subjected to such a test. For this reason, in many situations it is essential to make the connector fireproof in order to pass the test in an appliance.

FIG. 1 shows a RAST-type connector 100 with 5 mm pitch known in the prior art. The connector 100 shown in FIG. 1 is commonly known as an "AMP multifitting mark II", the technical characteristics of which can be found in the catalogue "RAST CONNECTOR SYSTEM IDC & CRIMP CONNECTOR SYSTEM AND RAST TAB HEADER" (catalogue number 1-1773727-3, Revised 4-14) from TE Connectivity Ltd. This connector 100 has four interconnecting lines.

The connector 100, as shown in FIG. 1, includes a single body with an upper portion 101 where the cables are coupled to the connector 100 and a lower portion 102 where the connector 100 is electrically connected to an external element. Inside the connector 100, there is a terminal configured to allow electrical connection between the connector 100 and at least one cable to which the connector 100 is connected.

The cable includes a conductive inner section and an insulating cover commonly referred to as a sheath. The internal conductive section may comprise either a single wire or a plurality of twisted wires (strands) allowing even distribution of the current density passing through the cable.

SUMMARY

An insulation displacement connector connecting to a sheathed insulated cable has a housing including a first portion and a second portion mechanically engaging the first portion. The first portion is made of a different material than the second portion.

BRIEF DESCRIPTION OF THE DRAWINGS

The invention will now be described by way of example with reference to the accompanying Figures, of which.

DETAILED DESCRIPTION OF THE EMBODIMENT(S)

The present invention is described below in particular embodiments with reference to the accompanying drawings. The same numbers and/or references indicate the same and/or similar and/or corresponding parts of the system. The present invention, however, is not limited to the particular embodiments described in the detailed description below and illustrated in the figures, but rather the embodiments described simply exemplify the various aspects of the present invention, the purpose of which is defined by the claims. Further changes relating to the present invention will become clear to a person skilled in the art. Finally, those areas considered to be known to those skilled in the art have not been described in order to avoid unnecessarily obscuring the invention described.

As will be clear from the below description, although a particular general shape of connector is illustrated in the figures, clearly the same inventive concept presented here can be applied to any other type of connector having different shapes and characteristics from those described in the figure; to, for example, any of the connectors in the above-mentioned catalogue.

Figure 2:
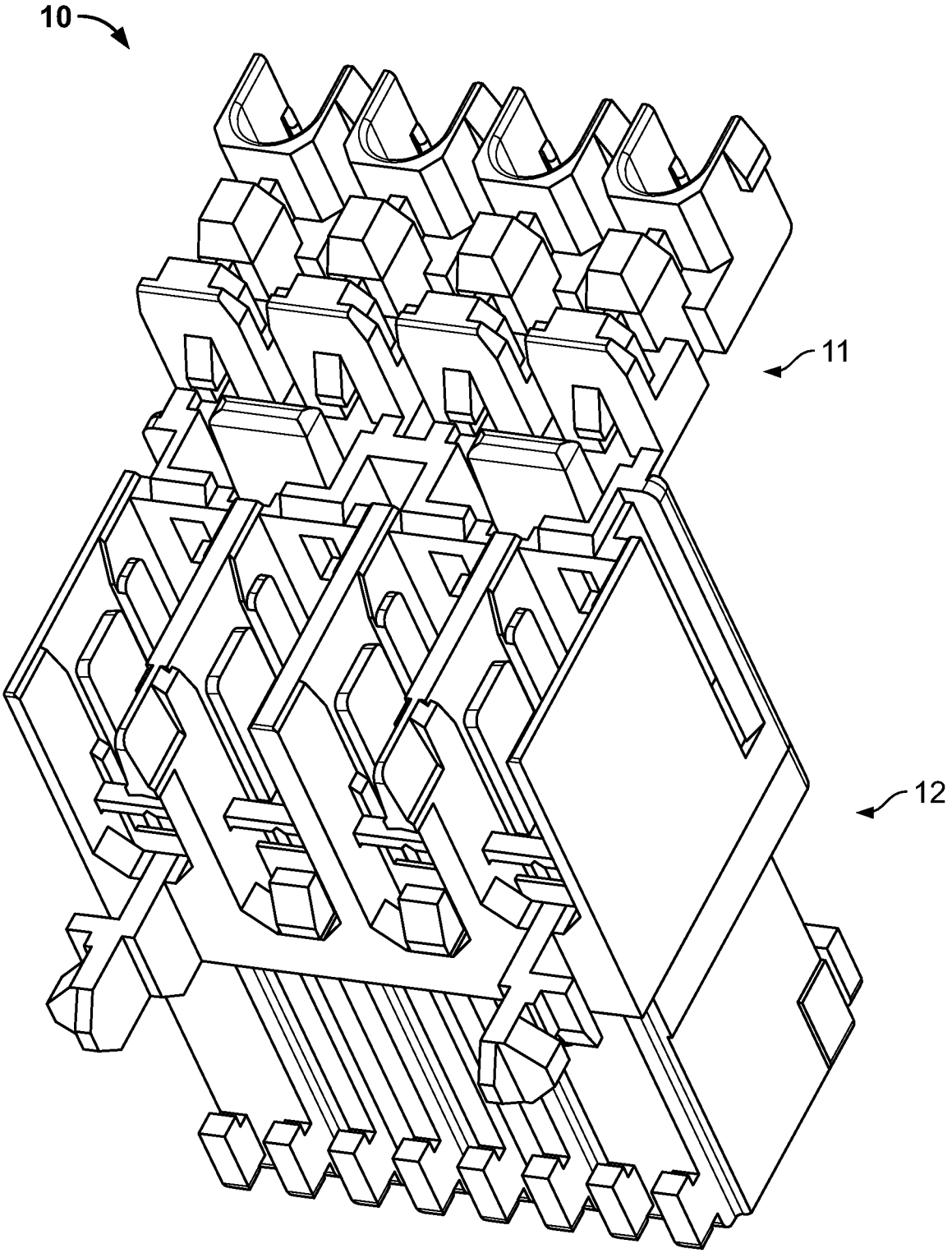
FIG. 2 is a perspective view of a connector according to an embodiment of the invention.

A connector 10 according to an embodiment of the invention is shown in FIG. 2. The connector 10 is a form of insulation displacement connector connecting to a plurality of sheathed insulated cables. The connector 10 has a housing configured to house a plurality of terminals inside the housing and isolate the terminals with respect to an area exterior of the connector 10. The terminals are electrically connected to the sheathed insulated cables.

Figure 1:
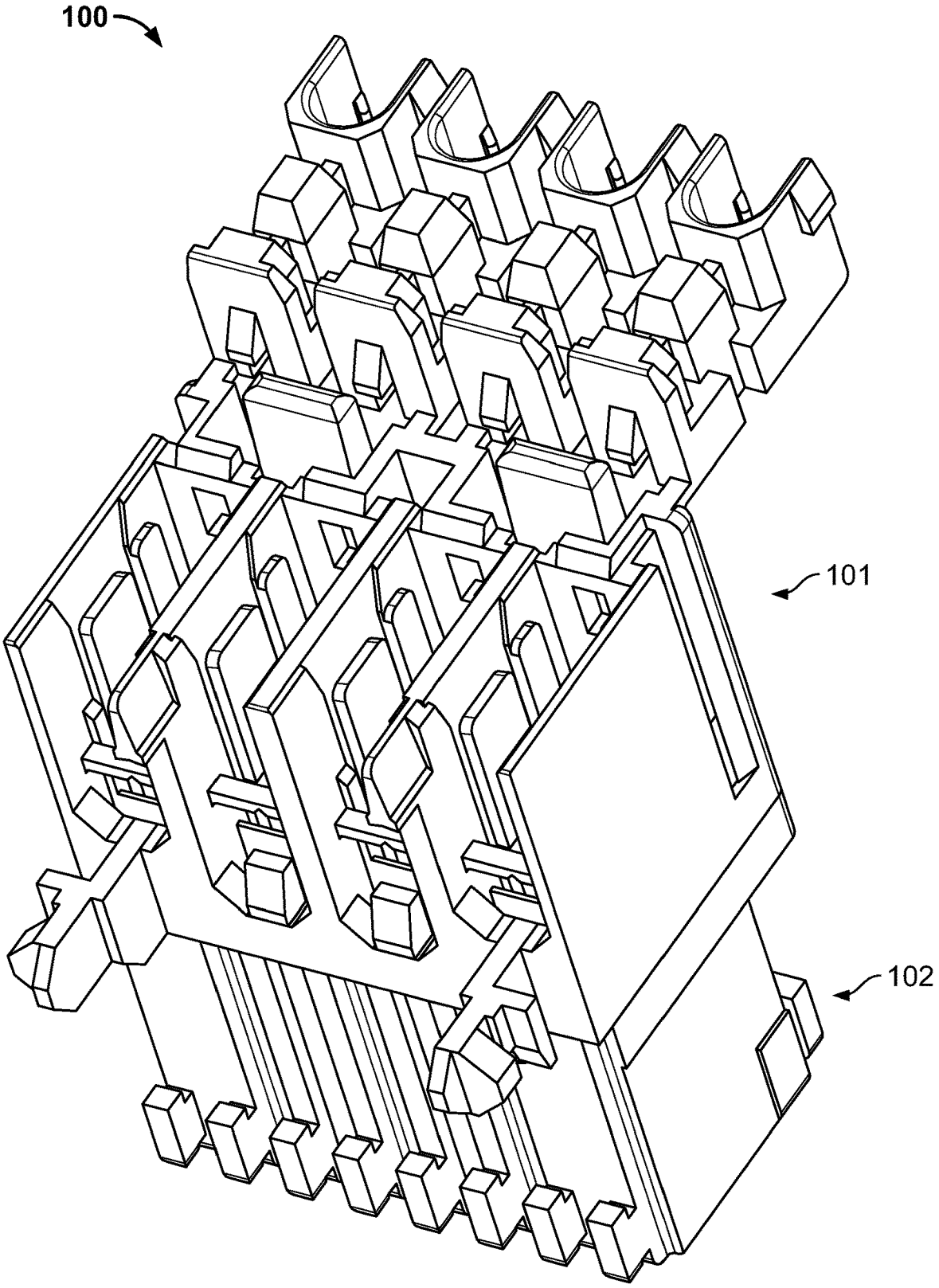
Fig. 1 [PRIOR ART]
FIG. 1 is a perspective view of a connector according to the prior art.

The housing of the connector 10, as shown in FIG. 2, includes an upper first portion 11 and a lower second portion 12. The connector 10 is formed by mechanical coupling between two different elements represented by the first portion 11 and the second portion 12. The fact that the connector 10 is formed by two different mechanically coupled portions 11, 12 makes it possible to have a connector 10 formed of two bodies of different material, therefore having different mechanical and chemical properties. For example, if it has been established that the higher thermal stress occurs in a particular area of the connector 10, one part 11, 12 may be made more resistant to flammability and one part 11, 12 less resistant. For example, the upper portion 101 of the connector 100 shown in the FIG. 1 ignited when subjected to the "Nichrome Wire Test". The first portion 11 shown in FIG. 2, in an embodiment, is thereby formed of a material offering a higher flammability resistance than that of the second portion 12.

In an embodiment, particularly flammability-resistant materials are used in the first portion 11. By way of example, without being limited to the particular choice of materials listed here, the first portion 11 may include at least one of the following compositions: polyamide with 30% glass fiber, polybutylene terephthalate with 30% glass fiber, polyethylene terephthalate and polyphenyl sulfide, which is a liquid crystal polymer, or another type of polymer that is by nature self-extinguishing.

In various embodiments, the second portion 12 may be made of polyamide, polyolefin or polybutylene terephthalate.

Figure 3:
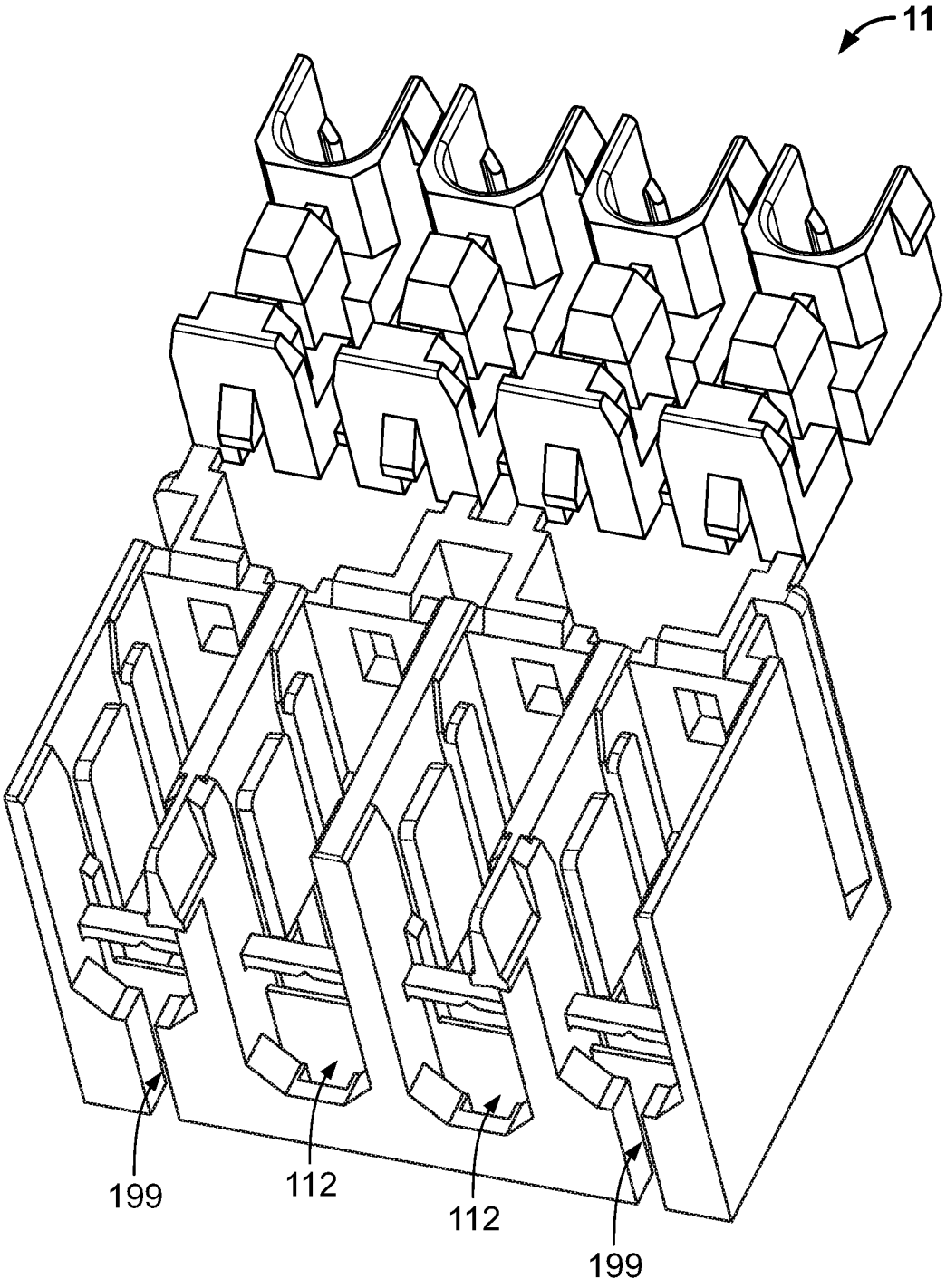
FIG. 3 is a perspective view of a first portion of the connector of FIG. 2.

The geometrical characteristics of the first and second portions 11 and 12 that enable coupling between these portions will be described in greater detail below with reference to FIGS. 3 and 4. FIG. 3 shows the first portion 11 which, in an embodiment, is made of a material that offers higher flammability resistance than the flammability resistance of the second portion 12.

As shown in FIG. 3, the first portion 11 has a female coupling system in a lower part that can connect the first portion 11 to the second portion 12 mechanically. The coupling system includes a plurality of contact surfaces 112 against which projections on the second portion 12, which will be described later, can be secured. Although not shown in the figure because they are hidden inside the first portion 11, as will be clearer from the remainder of this description, additional contact surfaces 112 on the first portion 11 are located in different planes in order to provide an effective mechanical fixing between the first portion 11 and the second portion 12.

In another embodiment, the first portion 11 may include a female coupling system comprising one or more engaging holes that allow one or more end portions of the second portion 12 to be inserted into these holes, so that the first portion 11 can be mechanically fixed to the second portion 12. It is clear that these holes, located for example on the inner or outer side walls of the first portion 11, can be used in combination or alternatively with the contact surfaces 112. The term side surfaces refers to all those surfaces perpendicular to the front surface (front view in FIG. 3) and extending along the coupling direction between the first portion 11 and the second portion 12.

Figure 4:
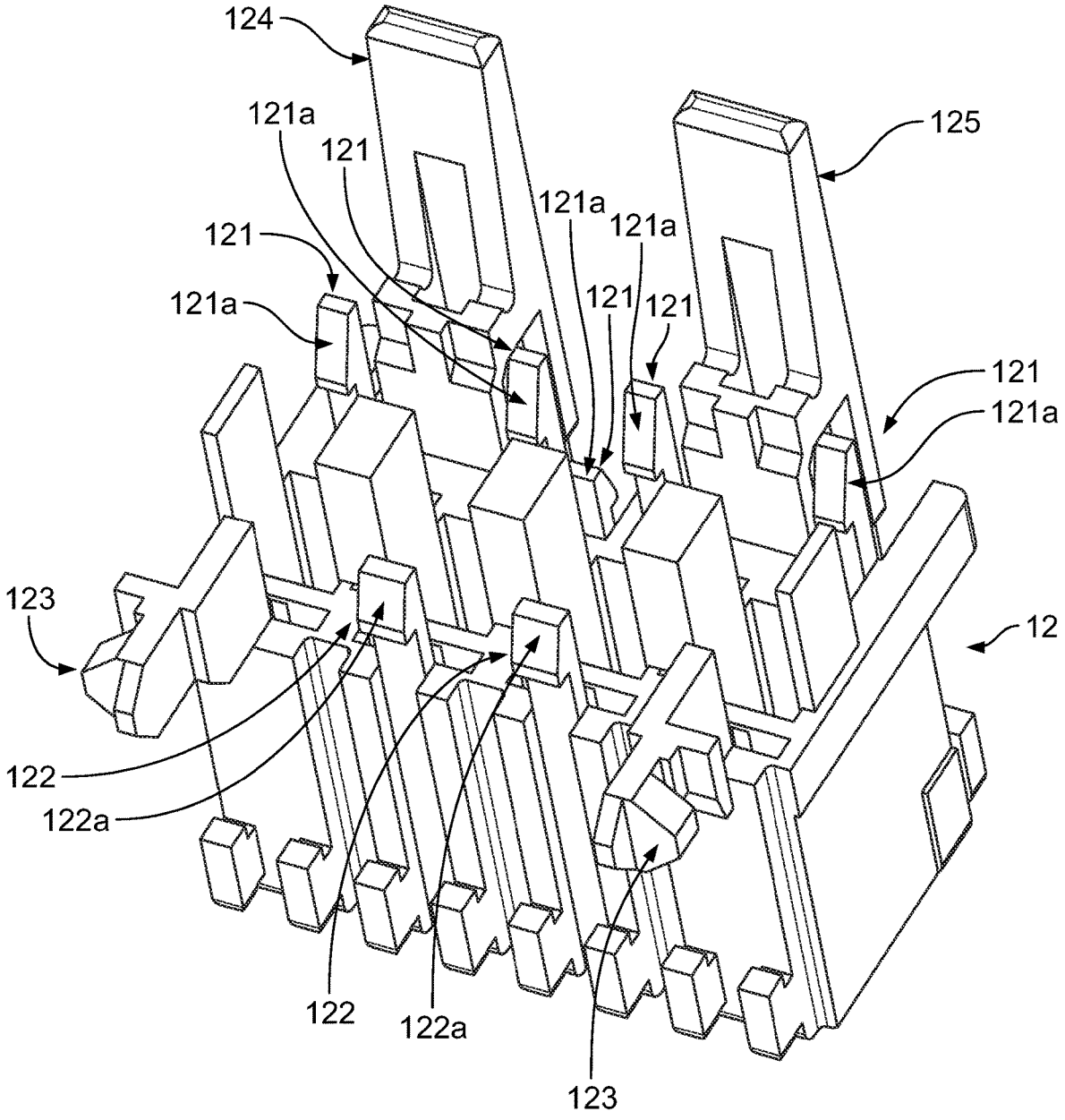
FIG. 4 is a perspective view of a second portion of the connector of FIG. 2.

As shown in FIG. 3, the first portion 11 includes a pair of grooves 199 which are configured to accommodate a pair of external coupling elements 123 shown in FIG. 4.

As shown in FIG. 4, the second portion 12 includes a male coupling system including a plurality of projecting elements 121-122 extending from the main body of the second portion 12 along a direction in which the second portion 12 is mechanically coupled to the first portion 11. These projecting elements 121-122 therefore enable the second portion 12 to be mechanically coupled to the female coupling system of the first portion 11. The second portion 12 includes a pair of second projecting elements 124 and 125.

As shown in FIG. 4, the plurality of projecting elements 121-122 extend perpendicularly from the main body of the second portion 12 and each have a catch 121*a*-122*a*, also referred to as a projection 121*a*-122*a*, configured so as to contact the contact surfaces 112 of the female coupling system of the first portion 11. The projecting elements 121-122 are able to be deformed in a direction perpendicular to the direction of extension of the projecting elements 121-122 so that the catches 121*a*-122*a* can contact the contact surfaces 112 of the first portion 11.

During the coupling operation, the catches 121*a*-122*a* will contact the surface of the first portion 11, causing the projecting elements 121-122 to flex, resiliently deforming, and then return to their perpendicular positions once the catches 121*a*-122*a* contact the contact surfaces 112, substantially providing a kind of snap-fastening system. The projecting elements 121-122 are thus able to block relative movement between the first portion 11 and the second portion 12 by their terminal portions including the catches 121*a*-122*a*. Therefore, when finally positioned between the first portion 11 and the second portion 12, the projections 121*a*-122*a* will be correctly positioned at a predetermined position along the contact surfaces 112.

It is clear that, in other embodiments, the number of projecting elements 121-122 can be varied as desired, depending on requirements. The projecting elements 121-122 may also be positioned in different planes in order to ensure better mechanical coupling.

Although the present invention has been described with reference to the embodiments described above, it will be clear to those skilled in the art that it is possible to make various modifications, variations and improvements to the present invention in the light of the teaching described above and within the scope of the appended claims without departing from the subject-matter and scope of protection of the invention.

For example, although it has been shown that the first portion 11 has a female coupling system and the second portion 12 has a male coupling system, it is possible to make the coupling system in the opposite way, i.e. with the first portion 11 having a male coupling system and the second portion 12 having a female coupling system.

For example, although a particular mechanical connection between the first portion 11 and the second portion 12 has been described, it is clear that this mechanical connection is not limited to the particular embodiment described in the figure, but can be any mechanical connection known to those skilled in the art.

Finally, it is clear that the example shown in the figures describes a multiple connector configured to allow coupling to four cables (thus having four interconnecting lines), but it is possible to apply the invention to larger or smaller connectors having more or fewer interconnecting lines. Similarly, if the connector is larger or smaller than those shown in the figures, it may have a number of projections on the second portion which is greater or smaller than that described in the figures.

In addition it is clear that, although it has been shown that the connector 10 is made by mechanical coupling between two elements (the first and second portions 11, 12), the connector 10 can also comprise more than two elements having different flammability-resistance characteristics.

The present invention is based on the discovery that the thermal stresses to which a connector 10 is subjected are not uniform, and therefore some portions of the connector 10 must withstand higher loads while other portions are subject to lower loads. Instead of making the entire connector 10 from extremely expensive and high-temperature-resistant material, it will be possible to limit this to the only portion where high thermal stress is expected, thus reducing the cost of the connector 10. Thanks to mechanical engagement between the first portion 11 and the second portion 12, it will therefore be possible to easily mechanically connect the two portions 11, 12, providing a connector 10 which is geometrically identical to one having a uniform body (as known in the prior art), but which has different properties. The connector 10 has high flammability resistance and is therefore able to pass the various tests required to meet current safety parameters.

What is claimed is:

1. An insulation displacement connector connecting to a sheathed insulated cable, comprising:

a housing including:

a first portion defining a vertical slot formed through an exterior wall thereof; and a second portion slidably engaging the first portion and including an external coupling element extending through the vertical slot as the first portion engages with the second portion, the first portion is made of a material that is distinct in chemical composition from a chemical composition of any material making up the second portion such that the first portion of the housing has a higher resistance to flammability than a resistance to flammability of the second portion of the housing.

2. The insulation displacement connector of claim 1, wherein the first portion and the second portion form a coupling system permitting mechanical coupling between the first portion and the second portion.

3. The insulation displacement connector of claim 1, wherein the first portion is at least one of polyamide with 30% glass fiber, polybutylene terephthalate with 30% glass fiber, polyethylene terephthalate, and polyphenyl sulfide.

4. The insulation displacement connector of claim 3, wherein the second portion is at least one of polyamide, polyolefin, or polybutylene terephthalate.

5. The insulation displacement connector of claim 1, wherein, with the second portion engaged with the first portion, the second portion is slidable linearly relative to the first portion.

6. The insulation displacement connector of claim 5, wherein the second portion is slidably received within the first portion.

7. The insulation displacement connector of claim 5, the first portion and the second portion define corresponding projections and grooves which are slidably engaged as the second portion is moved relative to the first portion.

8. The insulation displacement connector of claim 1, wherein the second portion has a male coupling system including a projecting element.

9. The insulation displacement connector of claim 8, wherein the projecting element resiliently deforms and engages the first portion.

10. The insulation displacement connector of claim 9, wherein the projecting element is resiliently deformable in an inward direction perpendicular to a direction of extension of the projecting element as the first portion is slidably engaged with the second portion.

11. The insulation displacement connector of claim 9, wherein the first portion has a female coupling system including an opening defining a contact surface.

12. The insulation displacement connector of claim 11, wherein the projecting element has a catch contacting the contact surface.

13. The insulation displacement connector of claim 11, wherein the contact surface at least partially defines the opening.

14. The insulation displacement connector of claim 13, wherein the contact surface faces inwardly, and the projecting element has a catch projecting outwardly and contacting the contact surface.

15. An insulation displacement connector, comprising:

a housing including:

a first portion having a pair of grooves formed through an exterior wall thereof and extending in a first direction; and a second portion mechanically engaging the first portion and having:

a pair of projections extending from an exterior thereof in a second direction, distinct from the first direction, the pair of projections slidably engaged in the pair of grooves such the second portion is movable relative to the first portion in only in the first direction with the pair of projections engaged within the pair of grooves; and a male coupling system including a plurality of projecting elements, wherein each projecting element is resiliently deformable in a direction perpendicular to the first direction and parallel to the second direction, wherein the first portion is made of a first material and the second portion made of a second material, the first material having a composition distinct from a composition of the second material such that the first portion of the housing has a chemical property distinct from a chemical property of the second portion of the housing.

16. The insulation displacement connector of claim 15, wherein the first material includes at least one of polyamide with 30% glass fiber, polybutylene terephthalate with 30% glass fiber, polyethylene terephthalate, or polyphenyl sulfide, and the second material includes at least one of polyamide, polyolefin, or polybutylene terephthalate.

17. The insulation displacement connector of claim 15, wherein the first material has a higher resistance to flammability than a resistance to flammability of the second material.

18. The insulation displacement connector of claim 15, wherein each projecting element is resiliently deformed in an inward direction as the first portion is mechanically engaged to the second portion.

19. The insulation displacement connector of claim 15, wherein the second portion is received within the first portion.

20. An insulation displacement connector connecting to a sheathed insulated cable, comprising:

a housing including a first portion formed of at least one of polyamide with 30% glass fiber or polybutylene terephthalate with 30% glass fiber and a second portion mechanically engaging the first portion, the first portion is made of a material that is distinct in chemical composition from a chemical composition of any material making up the second portion such that the first portion of the housing has a higher resistance to flammability than a resistance to flammability of the second portion of the housing.

* * * * *